US008250721B2

(12) United States Patent
Krawcheck et al.

(10) Patent No.: US 8,250,721 B2
(45) Date of Patent: Aug. 28, 2012

(54) ROOF PANEL SEAMING APPARATUS WITH LEADING GUIDE FINGER

(75) Inventors: Kenneth Krawcheck, Jackson, NJ (US); Bruce E. Meyer, Port Charlotte, FL (US)

(73) Assignee: Englert Inc., Perth Amboy, NJ (US)

( * ) Notice: Subject to any disclaimer, the term of this patent is extended or adjusted under 35 U.S.C. 154(b) by 893 days.

(21) Appl. No.: 12/316,742

(22) Filed: Dec. 16, 2008

(65) Prior Publication Data

US 2010/0071298 A1 Mar. 25, 2010

Related U.S. Application Data

(60) Provisional application No. 61/194,160, filed on Sep. 25, 2008.

(51) Int. Cl.
*B23P 11/00* (2006.01)

(52) U.S. Cl. ..... 29/243.5; 29/243.56; 52/588.1

(58) Field of Classification Search ..... 29/243.5, 29/243.517, 243.518, 243.526; 52/588.1
See application file for complete search history.

(56) References Cited

U.S. PATENT DOCUMENTS

| | | | | | |
|---|---|---|---|---|---|
| 2,160,336 | A | | 5/1939 | Maxfield | |
| 3,487,799 | A | | 1/1970 | Gronlund | |
| 3,662,699 | A | * | 5/1972 | Horn et al. | 29/243.5 |
| 3,771,482 | A | * | 11/1973 | Thompson | 29/243.5 |
| 3,875,642 | A | | 4/1975 | Knudson | |
| 4,027,611 | A | | 6/1977 | Ward et al. | |
| 4,064,819 | A | | 12/1977 | Fox | |
| 4,072,118 | A | * | 2/1978 | Schultheiss | 72/48 |
| 4,279,211 | A | | 7/1981 | Stellrecht | |
| 4,301,587 | A | | 11/1981 | Boyd | |
| 4,324,031 | A | * | 4/1982 | Isenhoff | 29/243.58 |
| 4,372,022 | A | * | 2/1983 | Puckett | 29/243.58 |
| 4,470,186 | A | | 9/1984 | Knudson | |
| 4,726,107 | A | * | 2/1988 | Knudson | 29/243.5 |
| 4,918,797 | A | * | 4/1990 | Watkins et al. | 29/243.5 |
| 4,989,308 | A | * | 2/1991 | Sanders | 29/243.5 |
| 5,604,966 | A | | 2/1997 | Morello et al. | |
| 6,115,899 | A | | 9/2000 | Rider | |
| 2010/0071297 | A1 | | 3/2010 | Meyer | |

OTHER PUBLICATIONS

"U.S. Appl. No. 12/316,741, Non Final Office Action mailed Nov. 21, 2011", 21 pgs.

* cited by examiner

*Primary Examiner* — Lee D Wilson
(74) *Attorney, Agent, or Firm* — Schwegman, Lundberg & Woessner, P.A.

(57) ABSTRACT

A roof panel seamer which is self-propelled and bidirectional for forming a standing seam joining two adjacent metal roof panels. Two seamers are disclosed, one for forming a 90° seam and the other for forming a 180° seam. Friction wheels, rather than gears, are used to transfer power from the main support body to the auxiliary support body of the seamer. The seamer includes five roll forming stations, the leading three of which are effective for each direction of travel. One of the roll forming stations for each direction of travel in the 90° seamer imparts a curve to the leg being bent. In the 90° seamer, a guide finger is mounted to both ends of one of the main and auxiliary support bodys, with the guide finger being effective to contact the underside of the male portion of the seam and maintain a minimum clearance between the male and female portions as the male and female portions enter the seamer.

4 Claims, 10 Drawing Sheets

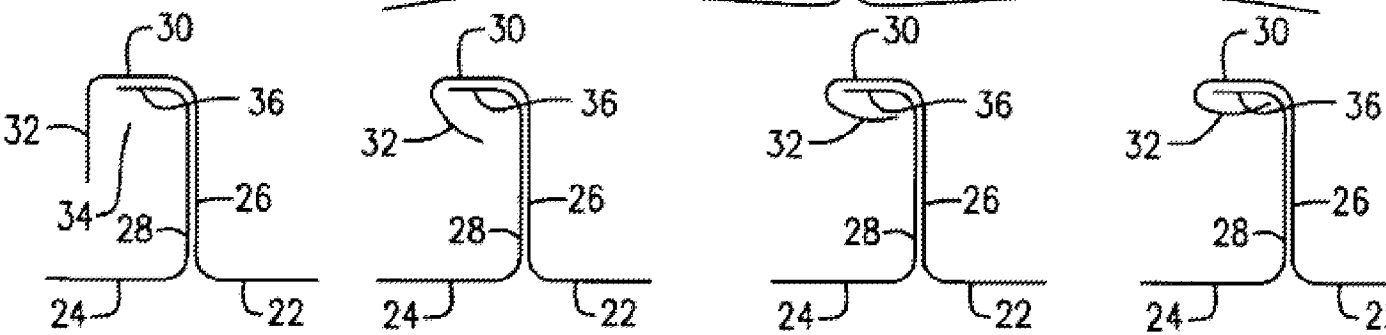
FIG. 2A
FIG. 2B
FIG. 2C
FIG. 2D
FIRST STAGE
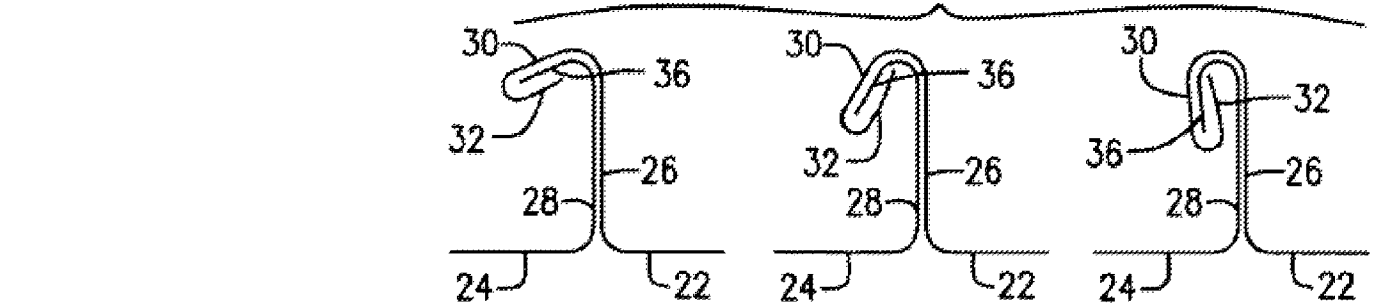
FIG. 2E
FIG. 2F
FIG. 2G
SECOND STAGE

ROOF PANEL SEAMING APPARATUS WITH LEADING GUIDE FINGER

CROSS-REFERENCE TO RELATED APPLICATION

The present application claims the benefit of Provisional Application Ser. No. 61/194,160, filed Sep. 25, 2008, and entitled "Roof Panel Seaming Apparatus". The contents of that application are hereby incorporated by reference.

BACKGROUND OF THE INVENTION

This invention relates to roof panel seamers and, more particularly, to a roof panel seamer which forms a standing 90° seam joining two adjacent metal roof panels.

Roof panel seamers have been used for many years to join, or connect, a pair of adjacent metal roof panels having abutting vertical portions, where one of the vertical portions is terminated by an outturned female flange portion with a downturned terminal portion forming a U-shaped channel, and the other of the vertical portions is terminated by an inturned male flange portion positioned in the U-shaped channel of the one vertical portion. The resulting seam has either a ninety degree (90°) or a one hundred eighty degree (180°) profile. Forming the 90° seam is called the first stage, and forming the 180° degree seam from a previously formed 90° seam is called the second stage.

In the real world, the structure underlying the roof panels is not perfectly flat, so that the male flange portion may be spaced from the female flange portion over a portion of the length of the roof panels. In order to have a "perfect" seam, the male flange portion should be up against the female flange portion as the vertical portions of the roof panels enter the seamer. It is therefore an object of this invention to insure that the male flange portion is up against the female flange portion as the vertical portions of the roof panel enter the seamer.

SUMMARY OF THE INVENTION

According to this invention, there is provided a seaming apparatus for connecting a pair of adjacent panels having abutting vertical portions, one of the vertical portions being terminated by an outturned female flange portion with a downturned terminal portion forming a U-shaped channel, and the other of the vertical portions being terminated by an inturned male flange portion positioned in the U-shaped channel of the one vertical portion. The inventive seaming apparatus comprises a main support body, a drive motor mounted to the main support body, an auxiliary support body, and clamp means operable to selectively move the auxiliary support body linearly toward and away from the main support body between a first position where the auxiliary support body is spaced from the main support body and a second position where the auxiliary support body is closely adjacent the main support body so that the seaming apparatus can straddle the vertical portions. The seaming apparatus further includes at least one primary transfer drive roller mounted for rotation to the main support body, a transmission connecting the drive motor to the at least one primary transfer drive roller, and at least one secondary transfer drive roller mounted for rotation to the auxiliary support body, wherein the periphery of each of the at least one secondary transfer drive roller contacts the periphery of a respective one of the at least one primary transfer drive roller when the auxiliary support body is in the second position. A guide finger is mounted to a leading end of one of the main and auxiliary support bodies, with the guide finger being effective to contact the underside of the male flange portion and maintain a minimum clearance between the male and female flange portions as the male and female flange portions enter the seaming apparatus. A plurality of roll forming stations are supported on the main and auxiliary support bodies with the roll forming stations being operative to bend the downturned terminal portion of the female flange portion against the underside of the inturned male flange portion as the first stage machine moves along the pair of adjacent panels so that the inturned male flange portion is captured by the female flange portion.

In accordance with an aspect of this invention, the guide finger is a J-shaped member having a substantially straight leg terminated by a curved leg tapered away from the straight leg. The seaming apparatus further comprises means for mounting a central portion of the straight leg for pivoting movement to one of the main and auxiliary support bodies, and a link member having first and second ends. The link member first end is pivotably mounted to the straight leg on the opposite side of the central portion from the curved leg and the link member second end is pivotably mounted to the other of the main and auxiliary support bodies.

BRIEF DESCRIPTION OF THE DRAWING

The foregoing will be more readily apparent from reading the following description in conjunction with the drawing in which like elements in different figures are identified by the same reference numeral and wherein:

FIGS. 2(A)-2(G) illustrate the steps by which a seamer constructed in accordance with the present invention forms first and second stage seams;

DETAILED DESCRIPTION

Figures 1A, 1B, 1C, 1D, 1E:
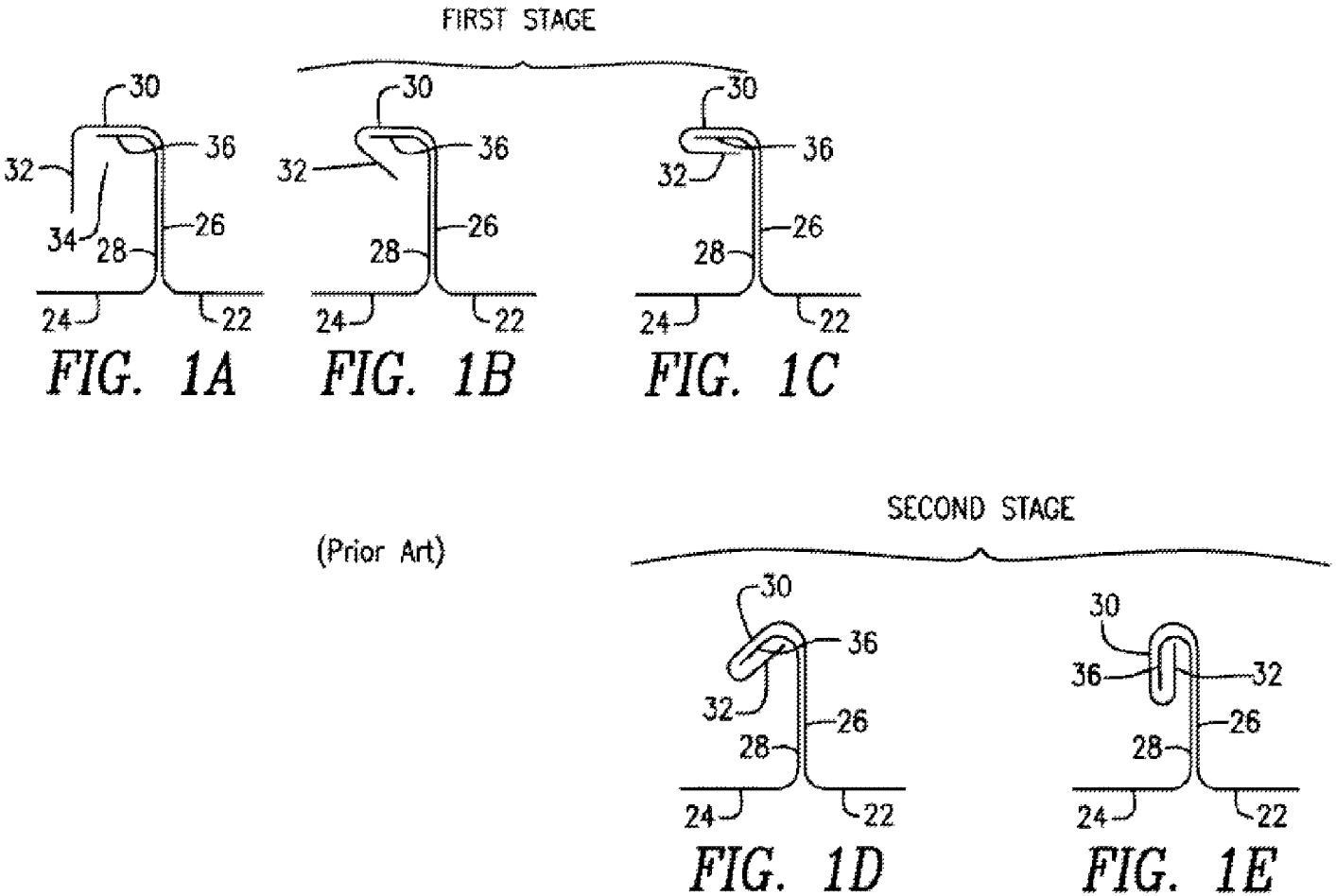
FIG. 1A FIG. 1B FIG. 1C FIG. 1D FIG. 1E (Prior Art)
FIGS. 1(A)-1(E) illustrate the steps by which a prior art seamer forms first and second stage seams.

Referring now to the drawing, FIG. 1 illustrates the steps used in prior art seamers to form a first stage (i.e., 90°) seam followed by a second stage (i.e., 180°) seam for connecting a pair of adjacent panels 22,24 having abutting vertical portions 26,28. As shown in FIG. 1A, the vertical portion 26 is terminated by an outturned female flange portion 30 with a downturned terminal portion 32 forming a U-shaped channel 34. The vertical portion 28 is terminated by an inturned male flange portion 36 positioned in the U-shaped channel 34 of the vertical portion 26. As described above, conventional prior art seamers utilized two roll forming stations per stage. Therefore, as shown in FIGS. 1A-1E, each roll forming station resulted in a straight 45° bending of the downturned terminal portion 32 (for the first stage) and a straight 45° bending of the female flange portion 30 and downturned terminal portion 32 along with the captured inturned male flange portion 36.

According to the present invention, as will become apparent from the following discussion, the improved seamer utilizes three roll forming stations per stage. FIGS. 2A-2G illustrate the steps used in the inventive seamer to form a first stage (i.e., 90°) seam followed by a second stage (i.e., 180°) seam for connecting the pair of adjacent panels 22,24. Thus, as shown in FIGS. 2B-2G, each roll forming station results in a 30° bending of the downturned terminal portion 32 (for the first stage) and a 30° bending of the female flange portion 30 and downturned terminal portion 32 along with the captured inturned male flange portion 36. In addition, as shown in FIG. 2B, the first 30° bending of the downturned terminal portion 32 also imparts a curve of the downturned terminal portion 32 toward the inturned male flange portion 36. Adding this curve to the downturned terminal portion 32 as it is rotated through to a 90° rotation reduces the pressure angle against each roll forming station by adding structure to the downturned terminal portion 32 during the forming process. This curve also aids in ensuring that the edge of the downturned terminal portion 32 is seated as tightly as possibly up against the underside of the seam, thus reducing interference with the first roll forming station of the second stage seamer. If this edge is not seated properly, the second stage seamer can malfunction and seam improperly.

Figure 3:
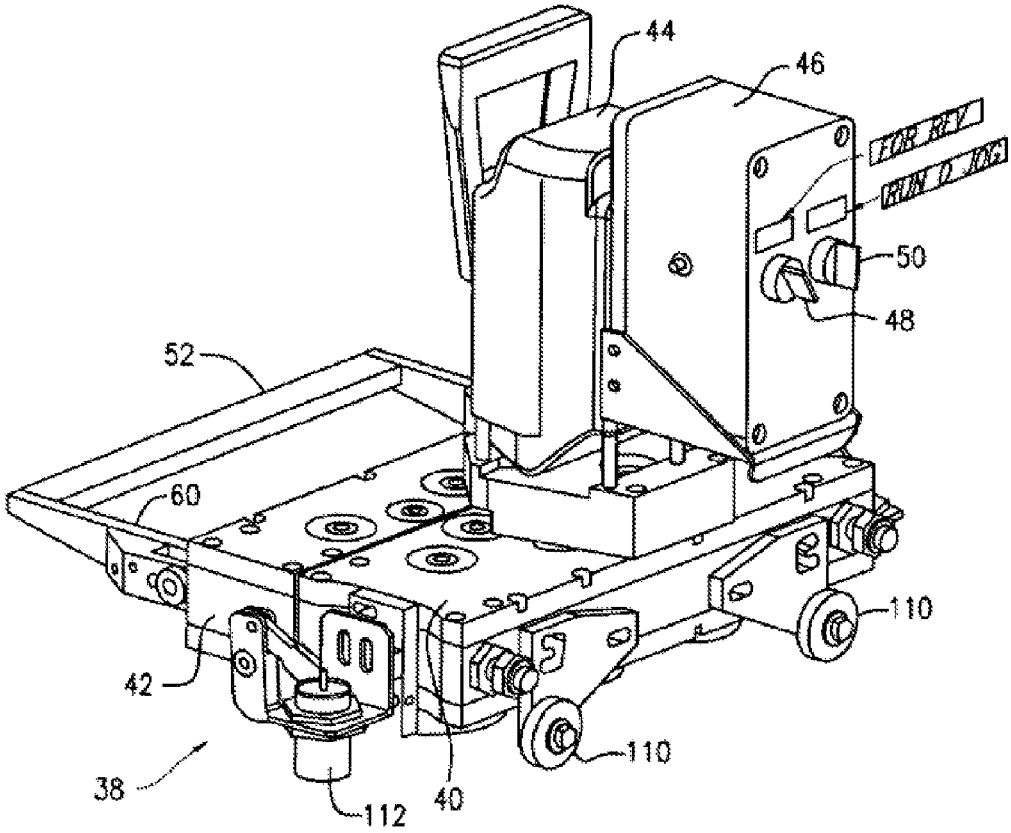
FIG. 3 is a top perspective view of a seamer constructed in accordance with the present invention.

FIG. 3 illustrates a first stage seamer, designated generally by the reference numeral 38 and constructed according to the present invention. As shown, the seamer 38 includes a main support body 40 and an auxiliary support body 42. A drive motor 44 is mounted to the main support body 40, as is an electrical box 46 which contains the control circuitry for operating the motor 44. Two switches 48 and 50 are mounted on the box 46 for providing manual control of the motor 44. The switch 48 is a two-position switch for controlling the direction of rotation of the motor 44, and hence the direction of movement of the seamer 38. The switch 50 is a three-position switch. The central position of the switch 50 maintains the motor 44 off. The left position of the switch 50 causes the motor 44 to run continuously. The right position of the switch 50 is a momentary contact position which causes the motor 44 to run so long as the switch 50 is held in its right position. This provides precise manual control of the seamer 38.

Figure 9:
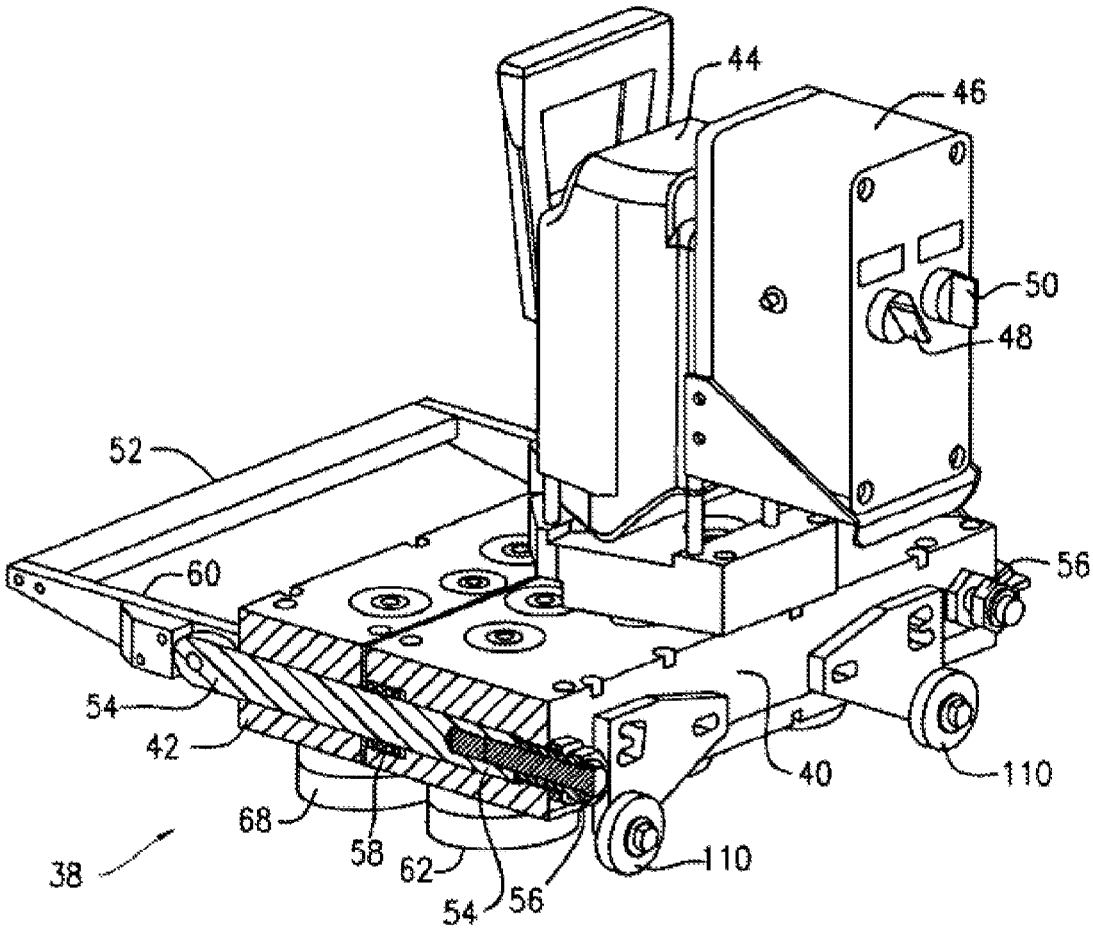
FIG. 9 is a cross sectioned perspective view of a seamer constructed in accordance with the present invention showing the clamping mechanism for the main and auxiliary bodies.
Figure 10:
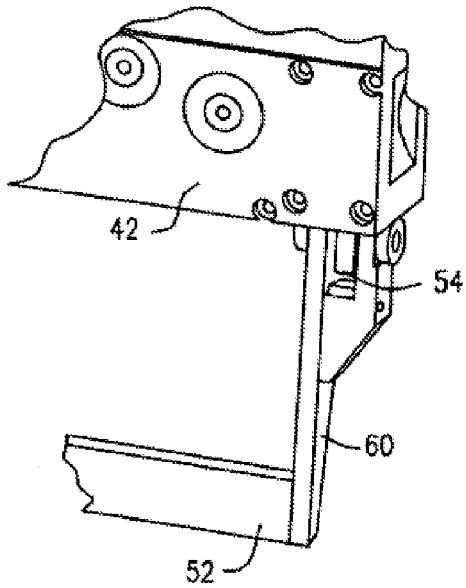
FIG. 10 is a detailed view of a portion of the clamping mechanism shown in FIG. 9.
Figure 11:
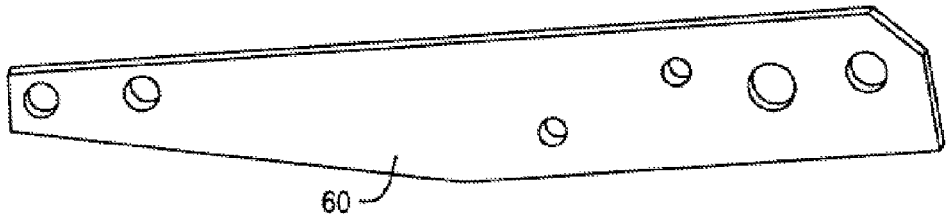
FIG. 11 is a detailed view of a portion of the clamping mechanism shown in FIG. 9, showing the camming lever.

The seamer 38 also includes a clamp handle 52 used to cause the auxiliary support body 42 to move toward and away from the main support body 40. The clamp handle 52 is part of a clamping mechanism which includes a guide rod 54 (FIG. 9) which extends through the auxiliary support body 42 and the main support body 40, where it is terminated by an adjustment nut 56 which is used to adjust the pressure on the drive rollers 62,64,66,68,70,72. A coil spring 58 surrounds a middle section of the guide rod 54 within an enlarged counterbore in the main support body 40 and exerts a separation force between the main support body 40 and the auxiliary support body 42. A camming lever 60 (FIG. 11) is secured at one end to the clamp handle 52 and is pivotably secured at its other end to the guide rod 54 (see FIG. 10). That other end of the camming lever 60 is configured so that when the camming lever 60 extends straight out from the auxiliary support body 42 the auxiliary support body 42 is held close to the main support body 40 against the separation force of the spring 58, and when the camming lever 60 is rotated ninety degrees from the extended position the auxiliary support body 42 is separated from the main support body 40.

Figure 4:
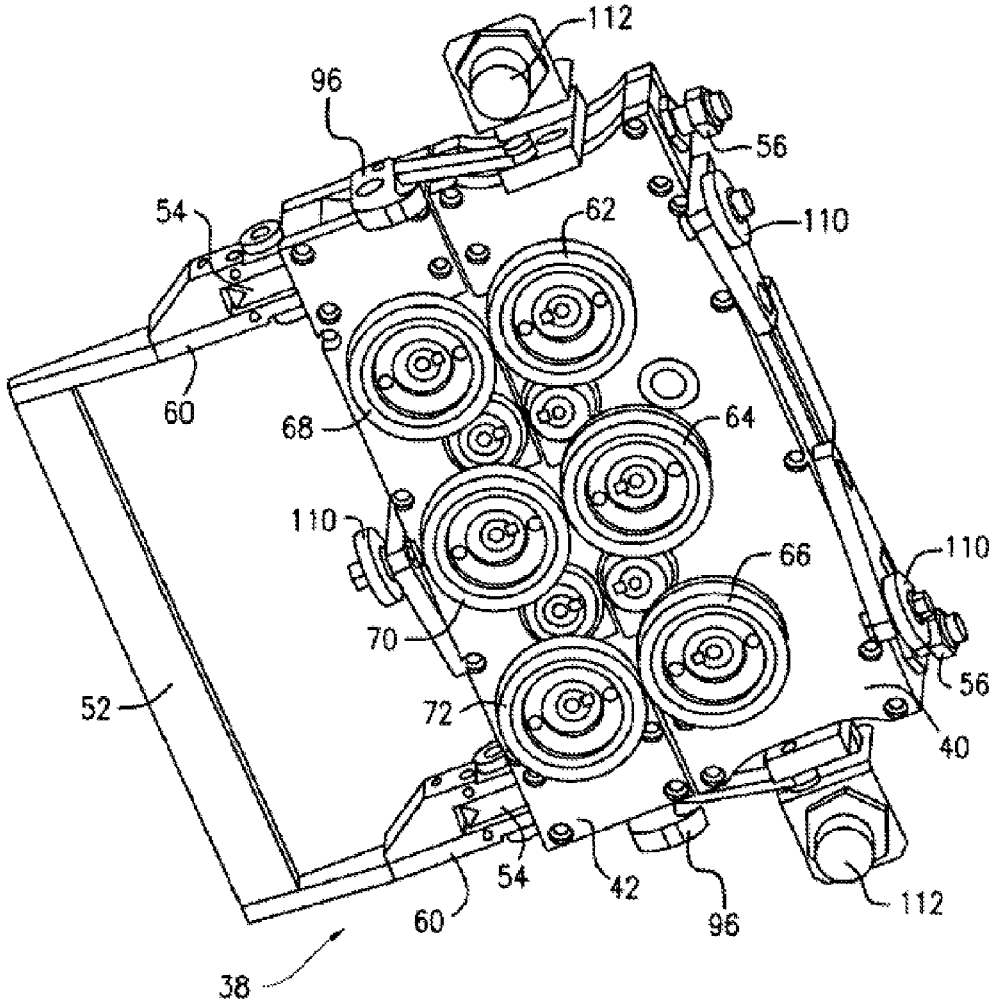
FIG. 4 is a bottom perspective view of a seamer constructed in accordance with the present invention.
Figure 5:
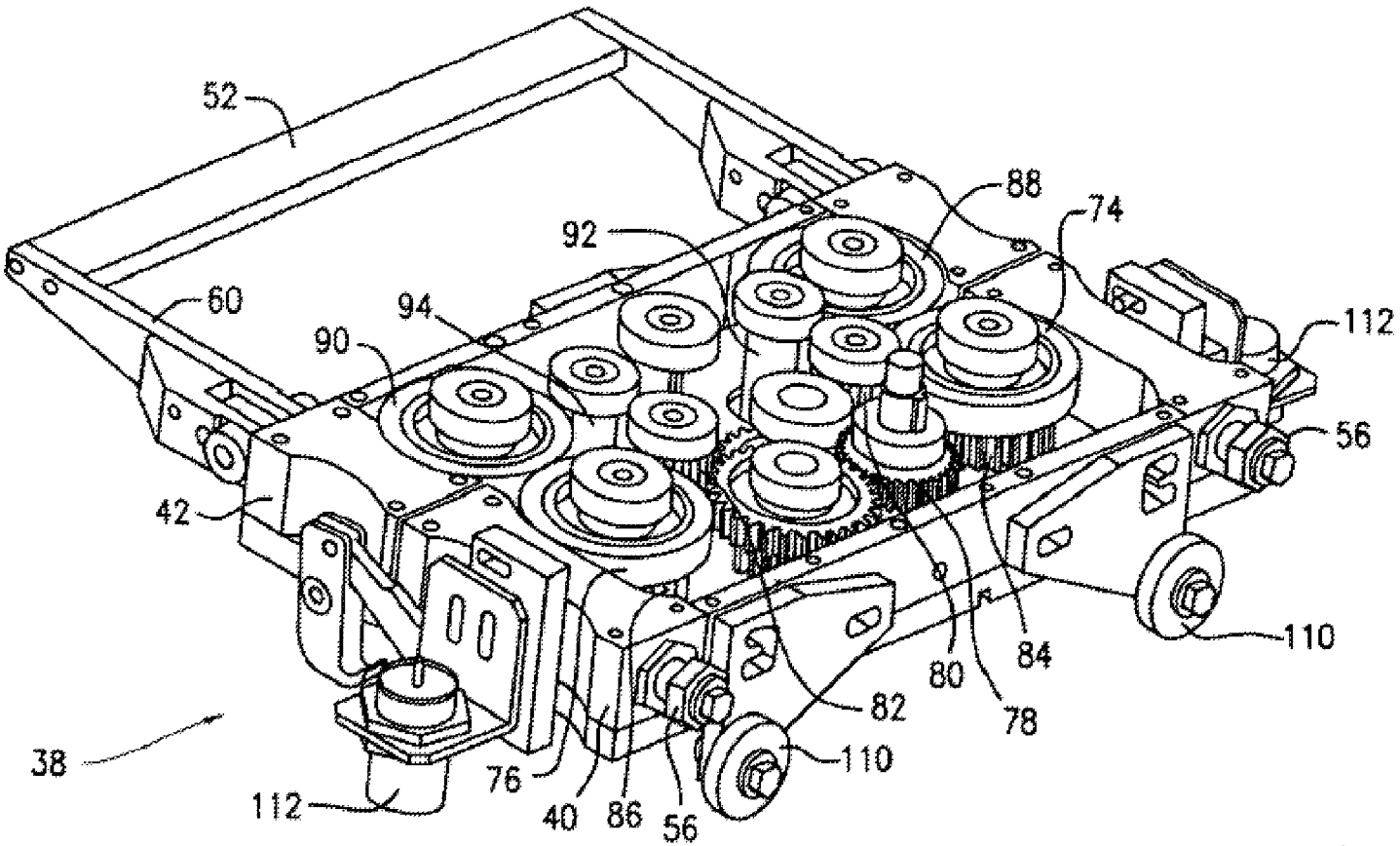
FIG. 5 is a top perspective view of the seamer shown in FIG. 3 with the drive motor and the top covers removed to expose the drive transmission.

FIG. 4 shows the underside of the seamer 38, where there are three primary drive rollers 62,64,66 mounted to the main support body 40 and three secondary drive rollers 68,70,72 mounted to the auxiliary support body 42. Each of the drive rollers 62-72 has a high coefficient of friction material covering its periphery. Preferably, this material is urethane. The purpose of the drive rollers 62-72 is to engage the vertical portions 26,28 of the panels 22,24 without damaging them and move the seamer 38 along the length of the panels when the drive rollers 62-72 are rotated. To rotate the drive rollers 62-72 there is provided a drive transmission shown in FIG. 5. The drive transmission is mounted to the main support body 40 and comprises gearing for coupling the output shaft (not shown) of the drive motor 44 to the primary transfer drive rollers 74,76. Thus, the drive motor output shaft is connected to the gear 78. Intermediate gears, including the idler gears 80,82, transfer motion to the gears 84,86 mounted on the shafts of the primary transfer drive rollers 74,76, respectively. The primary transfer drive roller 74 is mounted on the same shaft as the primary drive roller 66 and the primary transfer drive roller 76 is mounted on the same shaft as the primary drive roller 62.

According to this invention, each of the primary transfer drive rollers 74,76 has a high coefficient of friction material covering its periphery. Preferably, this material is urethane. Secondary transfer drive rollers 88,90, each of which has a high coefficient of friction material covering its periphery, preferably urethane, are mounted on the shafts of the secondary drive rollers 72,68, respectively. When the main and auxiliary support bodies 40,42 are clamped together, the urethane covering the primary transfer drive roller 74 contacts the urethane covering the secondary transfer drive roller 88, and the urethane covering the primary transfer drive roller 76 contacts the urethane covering the secondary transfer drive roller 90. Accordingly, there is no problem of gear disengagement and engagement when the main and auxiliary support bodies are separated and subsequently clamped together.

By connecting the main support body 40 to the auxiliary support body 42 by guide rods 54, this results in having maximum drive pressure capability and by utilizing a set of urethane friction drive rollers instead of a gear transfer system this eliminates the problem of gear engagement. There is an additional benefit to this type of design over the use of transfer gears. Because both the friction transfer drive roller and drive rollers are in constant contact with the opposing rollers, the friction transfer drive roller counters some of the forces that are transmitted from the drive roller, thus reducing the rotational forces acting on the auxiliary support body by about 18%. This adds to the stiffness of the whole assembly. In contrast to the friction transfer drive roller design, the transfer gear design must have an appreciable amount of extra clearance between gears to allow one to adjust the pressure on the drive roller, thus transferring the entire rotational load to the guide rods and reducing the stiffness of the whole assembly.

On a seamer, any increase in traction due to stiffness reduces slippage of the drive rollers and thus improves the wear characteristics of the friction drive rollers. As for the slippage between the friction transfer drive rollers, this should be minimal because the coefficient of friction between the rollers is higher then the coefficient of friction between the drive rollers and the surface of the seamed panel profile. The drive rollers will slip before the transfer drive rollers.

In prior art seamers, the forming stations were located along with the drive rollers. Because of this prior art design concept, the forming stations were spaced approximately 100 mm apart, because of the drive roller size. This limited the amount of stations that could be employed to keep the machine small and the weight of the machine within an acceptable limit of about 65 pounds for a single stage seamer. Consequently, in the prior art a 90° hem was formed with two stations, limiting the ability to form the panel hem efficiently. These seamers are also limited in their speed by the fact that they are able to use only a small drill motor for drive power because of the weight limitations. Therefore, the only way to increase the speed is to improve the efficiency by which the seam is formed.

The present invention utilizes the shafts of the idler gears 80,82, which are located between the drive rollers 62,64 and 64,66 and are required to allow all the drive rollers to turn in the same direction. An additional free spinning non-driving forming station is located on the main support body 40 on the shaft of each of the idler gears 80,82 between each of the two drive rollers 62,64 and 64,66, respectively, as well as on a corresponding free wheeling shaft on the auxiliary support body. This does not add any additional drag because there is no additional gearing being added to drive these stations. This addition is accomplished by nesting the forming stations between the drive stations to maximize support of the panel leg being formed. With a two station seamer from the prior art, the first station would form the lip of the panel to a 45 degree angle (FIG. 1B) and the second station would finish the lip to a full 90 degrees (FIG. 1C). By adding the extra free floating stations, this reduces the pressure angle against each station by approximately 33% because the forming process is distributed between three stations instead of two, resulting in a reduced pressure angle, and a smoother and more controlled seam. Nesting the stations in closer proximity to each other, also gives more support to the material as it is being formed. These extra added stations add minimum weight because of the utilization of the idler gear assemblies as the support shafts.

For 1" and 1½" leg panels, stress calculations of the panel profile leg that is being formed shows that approximately 185 mm of panel length is needed to properly form the 90° hem, or first stage seam. (Other profiles would be different.) The same holds true for the 180° hem, or second stage seam. The first drive station is located 85 mm from the start point of bending the leg up to 90°. The idler station is 50 mm past the first station and the final station is 50 mm past the idler station, for a total of 185 mm.

Figure 6:
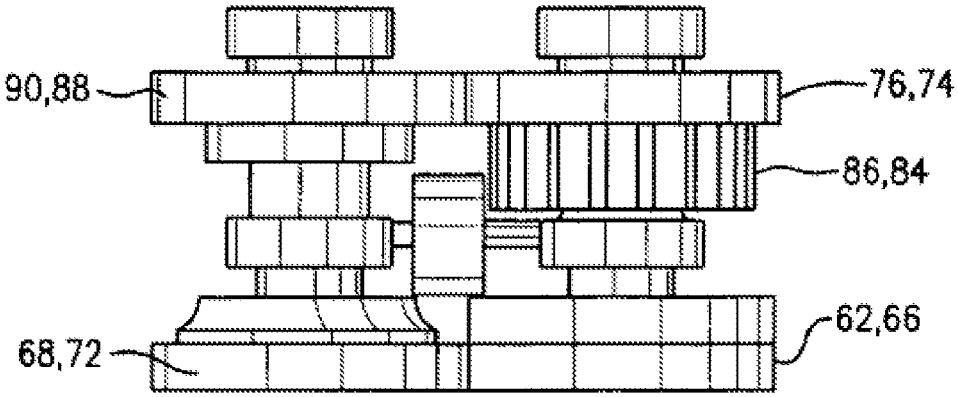
FIGS. 6-8 each illustrates a respective roll forming station for a first stage seamer constructed in accordance with the present invention.
Figure 7:
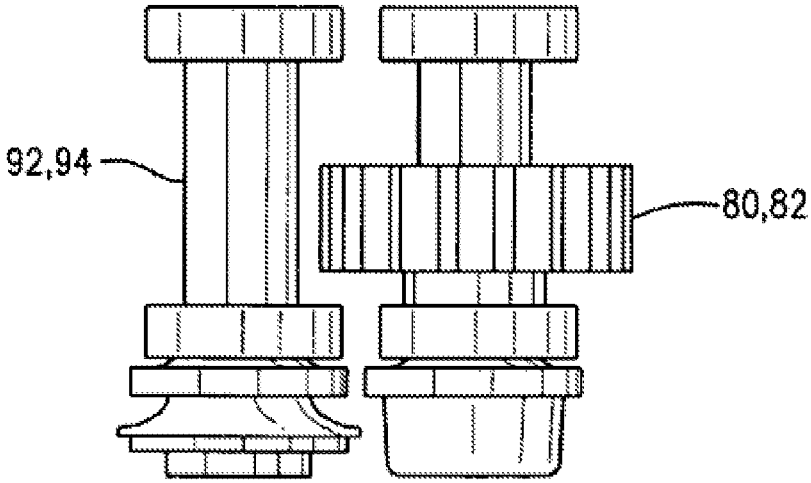
Figure 8:
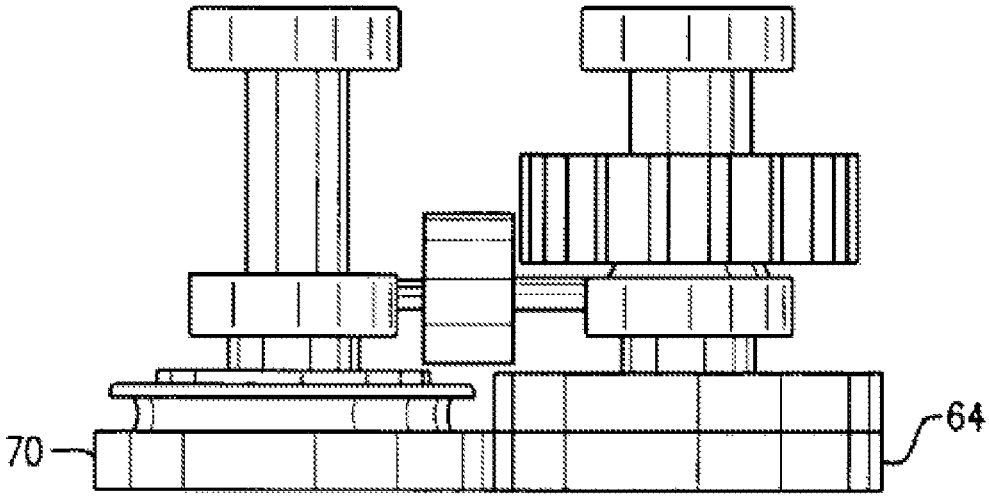

While the seamer 38 has five forming stations, only the leading three are used for each direction of travel of the seamer. As shown in FIG. 6, the first forming station for each direction of travel of the seamer 38 is mounted on the shafts for the transfer drive roller pairs 62,68 and 66,72. As shown in FIG. 7, the second forming station for each direction of travel of the seamer 38 is mounted on the shaft of the idler gear 80,82 and a corresponding free wheeling shaft 92,94 on the auxiliary support body. As shown in FIG. 8, the third forming station for both directions of travel of the seamer 38 is mounted on the shafts of the transfer drive rollers 64,70.

Figure 12:
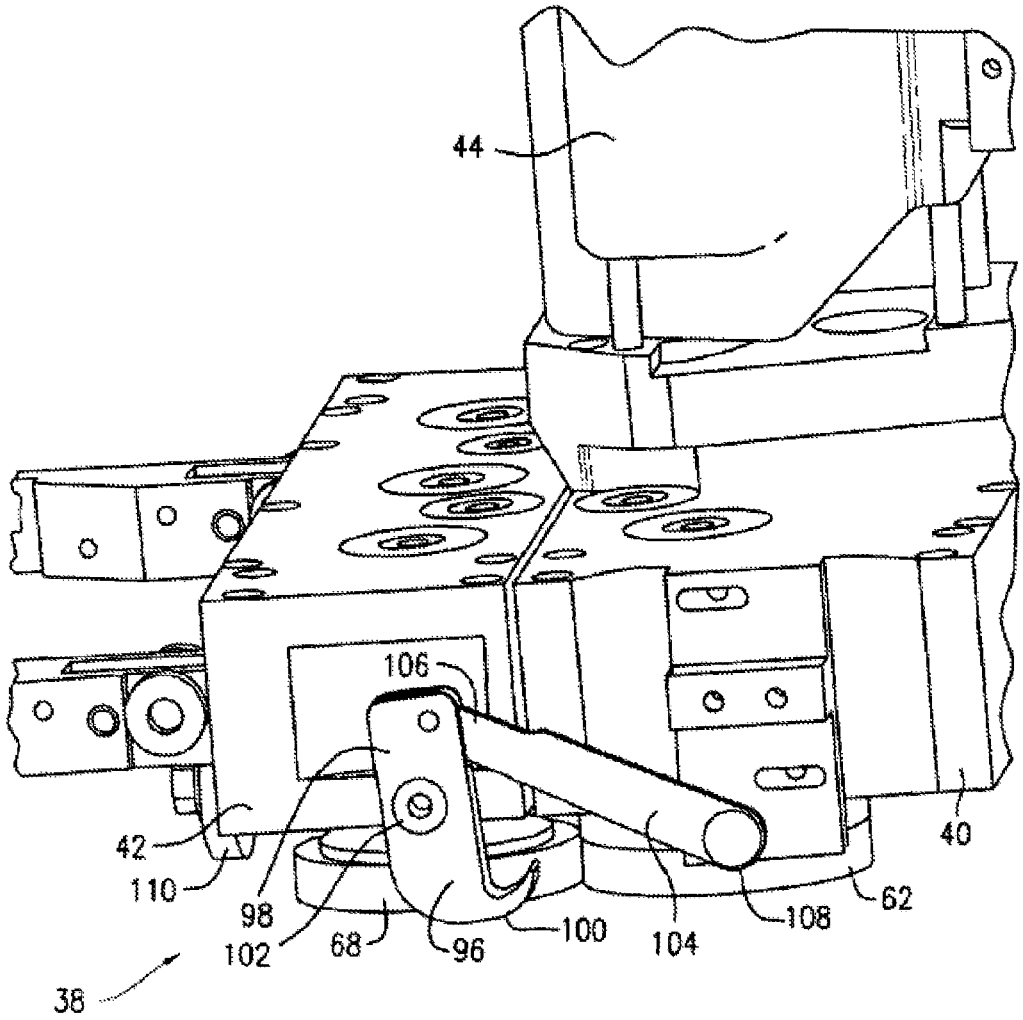
FIG. 12 is an enlarged perspective end view of a seamer constructed in accordance with the present invention showing a guide finger for insuring proper registration of the male and female flange portions of the panel vertical portions.

In the real world, the structure underlying the roof panels 22,24 is not perfectly flat, so that the male flange portion 36 may be spaced from the female flange portion 30 over a portion of the length of the roof panels. In order to have a "perfect" seam, the male flange portion 36 should be up against the female flange portion 30 as the vertical portions 26, 28 of the roof panels enter the seamer. To insure that the male flange portion 36 is properly seated against the female flange portion 30, a guide finger 96 (FIG. 12) is provided at both ends of the seamer 38. The guide finger 96 is a J-shaped member having a substantially straight leg 98 terminated by a curved leg 100 which tapers away from the straight leg 98. A central portion of the straight leg 98 is mounted at 102 to the auxiliary support body 42 for pivoting movement relative thereto. A link 104 has a first end 106 and a second end 108. The link first end 106 is pivotably mounted to the straight leg 98 on the opposite side of the central portion 102 from the curved leg 100, and the link second end 108 is pivotably mounted to the main support body 40. This linkage rotates the guide finger 96 into place as the seamer 38 is closed. As it is rotated, the guide finger 96 guides the male flange portion 36 up against the female flange portion 30 as the seamer 38 moves along the seam.

The seamer 38 also includes a plurality of skate rollers 110 which maintain the seamer 38 at a proper distance above the panels 22,24 being seamed and allow the seamer to roll over the panels. In addition, at each end of the seamer 38 there is provided a sensor 112, preferably of the optical type, which is mounted about two inches from each end. The purpose of the sensors 112 is to provide a signal when the seamer 38 reaches the end of the panels being seamed. This signal is used by circuitry (not shown) to turn off the drive motor 44.

There has been described a two seamer concept wherein the 90° seam and the 180° seam are seamed on separate seaming machines, but the same ideas can be also be used on a two stage seamer as well. Most seamers today are of the two stage design. This means that the seam is formed from beginning right through to the 180° finished seam. It has been reported that the operator tends to walk with the seamer to insure that the first stage seam will not improperly seam and damage the panels being seamed. Operating a seamer in this manner creates two specific issues. First, the operator has to walk up and down each panel along the entire roof. This can result in damage to the painted surface of a new roof. Secondly, with these two stage seamers one can only seam in one direction, thus requiring returning the seaming machine to the other end of the roof to proceed with the seaming operation. By seaming the 90° and the 180° seam with separate bidirectional machines allows one to seam the roof at a significant decrease of time utilizing two operators. One operator would be stationed at the ridge and the other at the eave of the roof. This eliminates most of the walking on the roof, reducing possible damage to the roof coating.

In use, a first operator takes the seamer 38 to a first end of the panels to be seamed and a second operator goes to the other end of the panels. The first operator then uses the clamp handle 52 to separate the auxiliary support body 42 from the main support body 40 and straddles the vertical portions 26,28 with the main support body 40 on the side of the vertical portion 26 and the auxiliary support body 42 on the side of the vertical portion 28. The switch 48 is then moved to the reverse (REV) position and the switch 50 is held in the JOG position until the seamer 38 completes seaming all the way to the first end of the panels, a relatively short distance. The first operator then moves the switch 48 to the forward (FOR) position and the switch 50 to the RUN position. The seamer then travels the length of the panels toward the second end, until the sensor 112 on the leading end of the seamer 38 causes the drive motor 44 to be turned off. The second operator moves the switch 50 to the JOG position and runs the seamer 38 until seaming is completed all the way to the second end of the panels. The second operator then uses the clamp handle 52 to separate the auxiliary support body 42 from the main support body 40 and removes the seamer 38 from the completed seam. The aforedescribed procedure is then repeated on the next pair of vertical portions 26,28 (reversing the forward and reverse directions) to send the seamer 38 back to the first operator. Thus, walking on the roof panels is substantially eliminated.

Accordingly, there has been disclosed a roof panel seamer which is self-propelled and bidirectional for forming a standing seam joining two adjacent metal roof panels. While an illustrative embodiment of the present invention has been disclosed herein, it will be appreciated that various adaptations and modifications to the disclosed embodiment are possible without departing from the spirit and scope of the invention. It is therefore intended that this invention be limited only by the scope of the appended claims.

What is claimed is:

1. A seaming apparatus for connecting a pair of adjacent panels having abutting vertical portions, one of the vertical portions being terminated by an outturned female flange portion with a downturned terminal portion forming a U-shaped channel, and the other of the vertical portions being terminated by an inturned male flange portion positioned in the U-shaped channel of the one vertical portion, said seaming apparatus comprising:

a main support body;

a drive motor mounted to said main support body;

an auxiliary support body;

clamp means operable to selectively move said auxiliary support body linearly toward and away from said main support body between a first position where said auxiliary support body is spaced from said main support body and a second position where said auxiliary support body is closely adjacent said main support body so that said seaming apparatus can straddle said vertical portions;

at least one primary transfer drive roller mounted for rotation to said main support body;

a transmission connecting said drive motor to said at least one primary transfer drive roller;

at least one secondary transfer drive roller mounted for rotation to said auxiliary support body, wherein the periphery of each of said at least one secondary transfer drive roller contacts the periphery of a respective one of said at least one primary transfer drive roller when said auxiliary support body is in said second position;

a guide finger mounted to a first end of one of said main and auxiliary support bodies, said guide finger being effective to contact the underside of said male flange portion and maintain a minimum clearance between said male and female flange portions as said male and female flange portions enter said seaming apparatus when said seaming apparatus is moving in a first direction; and a plurality of roll forming stations supported on said main and auxiliary support bodies with said roll forming stations being operative to bend said downturned terminal portion of said female flange portion against the underside of said inturned male flange portion as said seaming apparatus moves along said pair of adjacent panels so that the inturned male flange portion is captured by the female flange portion.

2. The seaming apparatus according to claim 1 wherein said guide finger is a J-shaped member having a substantially straight leg terminated by a curved leg tapered away from said straight leg, the seaming apparatus further comprising:

means for mounting a central portion of said straight leg for pivoting movement to said one of said main or auxiliary support bodies; and a link member having first and second ends, wherein said link member first end is pivotably mounted to said straight leg on the opposite side of said central portion from said curved leg and said link member second end is pivotably mounted, adjacent said central portion, to the other of said main or auxiliary support bodies.

3. The seaming apparatus according to claim 1 wherein said drive motor is bidirectional and said plurality of roll forming stations are effective to connect said pair of adjacent panels for both directions of movement of said seaming apparatus, the seaming apparatus further comprising:

a second guide finger mounted to a second end, the second end on an opposite end of said main and auxiliary support bodies from said first end, said second guide finger being effective to contact the underside of said male flange portion and maintain a minimum clearance between said male and female flange portions as said male and female flange portions enter said seaming apparatus when said seaming apparatus is moving in a second direction opposite to said first direction.

4. The seaming apparatus according to claim 3 wherein said second guide finger is a J-shaped member having a substantially straight leg terminated by a curved leg tapered away from said second guide finger straight leg, the seaming apparatus further comprising:

means for mounting a central portion of said second guide finger straight leg for pivoting movement to said second end, said central portion pivotably mounted to one of said main or auxiliary support bodies; and a second link member having first and second ends, wherein said second link member first end is pivotably mounted to said second guide finger straight leg on the opposite side of said central portion from said curved leg and said second link member second end is pivotably mounted to the second end, adjacent said central portion of said second guide finger, of the other of said main or auxiliary support bodies.

* * * * *